US009953797B2

(12) United States Patent
Zhang et al.

(10) Patent No.: US 9,953,797 B2
(45) Date of Patent: Apr. 24, 2018

(54) FLEXIBLE FLAT EMITTER FOR X-RAY TUBES

(71) Applicant: General Electric Company, Schenectady, NY (US)

(72) Inventors: Xi Zhang, Ballston Lake, NY (US); Mark Alan Frontera, Ballston Lake, NY (US); Sergio Lemaitre, Whitefish Bay, NY (US); John Scott Price, Niskayuna, NY (US); Uwe Wiedmann, Clifton Park, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 214 days.

(21) Appl. No.: 14/867,396

(22) Filed: Sep. 28, 2015

(65) Prior Publication Data

US 2017/0092456 A1 Mar. 30, 2017

(51) Int. Cl.

| | |
|---|---|
| ***H01J 35/02*** | (2006.01) |
| ***H01J 35/06*** | (2006.01) |
| ***H01J 35/16*** | (2006.01) |
| ***H01J 9/04*** | (2006.01) |
| ***H01J 1/16*** | (2006.01) |

(52) U.S. Cl.

CPC ..... *H01J 35/06* (2013.01); *H01J 1/16* (2013.01); *H01J 9/042* (2013.01); *H01J 35/02* (2013.01)

(58) Field of Classification Search

CPC ..... H01J 35/06
USPC ..... 378/136
See application file for complete search history.

(56) References Cited

U.S. PATENT DOCUMENTS

| | | | | |
|---|---|---|---|---|
| 6,426,587 | B1 | 7/2002 | Hell et al. | |
| 6,646,366 | B2 * | 11/2003 | Hell | H01J 35/06 313/310 |
| 7,085,354 | B2 * | 8/2006 | Kanagami | H01J 35/06 378/134 |
| 7,257,194 | B2 * | 8/2007 | Smith | H01J 35/14 378/119 |
| 7,271,530 | B2 * | 9/2007 | Kuribayashi | H01J 1/16 313/271 |
| 7,327,829 | B2 * | 2/2008 | Chidester | H01J 35/06 378/136 |

(Continued)

FOREIGN PATENT DOCUMENTS

| | | |
|---|---|---|
| DE | 10012203 C1 | 7/2001 |
| DE | 102008047216 A1 | 4/2010 |

*Primary Examiner* — Allen C. Ho
(74) *Attorney, Agent, or Firm* — Pabitra K. Chakrabarti

(57) ABSTRACT

A flat emitter configured for use in an X-ray tube is presented. The X-ray tube includes a first conductive section including a first terminal. Further, the X-ray tube includes a second conductive section including a second terminal. Also, the X-ray tube includes a third conductive section disposed between the first conductive section and the second conductive section, wherein the third conductive section is configured to emit electrons toward a determined focal spot, and wherein the third conductive section includes a plurality of slits subdividing the third conductive section into a winding track coupled to the first conductive section and the second conductive section, wherein at least two of the plurality of slits are interwound spirally to compose the winding track, and wherein the winding track is configured to expand and contract based on heat provided to the third conductive section.

21 Claims, 6 Drawing Sheets

(56) References Cited

U.S. PATENT DOCUMENTS 7,333,592 B2 * 2/2008 Nonoguchi ..... G21K 1/06 378/136
7,352,846 B2 * 4/2008 Kuribayashi ..... H01J 35/06 313/344
7,471,035 B2 12/2008 Wirz
7,657,002 B2 * 2/2010 Burke ..... H01J 35/06 378/136
7,693,265 B2 * 4/2010 Hauttmann ..... H01J 35/06 378/136
7,860,219 B2 * 12/2010 Clark ..... H01J 3/027 378/136
7,903,788 B2 * 3/2011 Moore ..... H01J 35/06 378/121
7,924,983 B2 * 4/2011 Moore ..... H01J 1/15 378/122
8,000,449 B2 8/2011 Hauttmann et al.
8,027,433 B2 * 9/2011 Zou ..... H01J 35/045 313/447
8,077,829 B2 * 12/2011 Moore ..... H01J 1/20 378/136
8,155,273 B2 4/2012 Eaton et al.
8,175,222 B2 * 5/2012 Moore ..... H01J 35/06 378/129
8,183,756 B2 * 5/2012 Terletska ..... H01J 1/13 313/310
8,247,971 B1 * 8/2012 Bard ..... H01J 1/16 313/310
8,254,526 B2 * 8/2012 Hauttmann ..... H01J 1/13 378/136
8,294,350 B2 * 10/2012 Freudenberger ..... H01J 1/16 313/341
8,385,506 B2 * 2/2013 Lemaitre ..... H01J 1/20 378/136
8,396,185 B2 * 3/2013 Zou ..... A61B 6/032 378/112
8,451,976 B2 * 5/2013 Canfield ..... H01J 35/06 378/136
8,548,124 B2 * 10/2013 Hauttmann ..... H01J 35/06 378/136
8,831,178 B2 9/2014 Lemaitre
8,938,050 B2 * 1/2015 Lemaitre ..... H01J 35/06 378/113
9,202,663 B2 * 12/2015 Yoshizawa ..... H01J 35/06
9,251,987 B2 * 2/2016 Zhang ..... H01J 1/16
9,443,691 B2 * 9/2016 Robinson ..... H01L 23/367
9,466,455 B2 * 10/2016 Hubbard ..... H01J 35/06
9,472,371 B2 * 10/2016 Virshup ..... H01J 35/06
9,653,248 B2 * 5/2017 Ishihara ..... H01J 35/06
9,659,741 B2 * 5/2017 Canfield ..... H01J 35/06
9,666,772 B2 * 5/2017 Ibbetson ..... H01L 33/54
9,711,320 B2 * 7/2017 Zou ..... H01J 35/06
2004/0227149 A1 11/2004 Ibbetson et al.
2010/0189223 A1 7/2010 Eaton et al.
2010/0207508 A1 8/2010 Terletska et al.

* cited by examiner

FLEXIBLE FLAT EMITTER FOR X-RAY TUBES

BACKGROUND

Embodiments of the present specification relate generally to X-ray tubes, and more particularly to a flexible flat emitter in the X-ray tubes.

Typically, an X-ray tube is provided with tube current that heats an emitter in the X-ray tube to emit electrons towards a focal spot in the X-ray tube. In conventional systems, emitters are made of tungsten filament consisting of coiled wires. However, these filament emitters have very less emission area, which results in slow computed tomography (CT) scans or interventional scans. Also, as these emitters have small area, the emitters may heat up to a very high temperature during operation. As a consequence, the emitters may have very high evaporation rate that may physically damage the emitters and/or the X-ray tube.

In other conventional systems, thermionic flat emitters are employed in the X-ray tube for emitting the electrons. The thermionic flat emitters are more convenient to provide a larger emission area than traditional filament emitters. The thermionic flat emitters include emission segments that are separated by slots. Also, the area of flat emitters may be easily increased compared to the filament emitters. As a result, the temperature of the flat emitters is lower than the temperature of the filament emitters for similar amount of emission, and as a consequence the evaporation rate of the material of the flat emitters is less in comparison to that of the material of the filament emitters. Therefore, the flat emitters have an excellent life advantage. However, thermal cyclic deformation of the flat emitters is a challenge due to higher stiffness in the flat emitters. Particularly, when the emitters are subjected to cyclic thermal loading, it is often observed that the flat emitters exhibit lower flexibility as compared to the filament emitters. Due to lower flexibility, the flat emitters tend to distort/deform permanently over a period of time. Also, this deformation in the flat emitters may cause the flat emitters to lose their original shape and flatness. As a consequence, the focal spot quality of the flat emitters in the X-ray tube may degrade over a period of time.

BRIEF DESCRIPTION

In accordance with aspects of the present specification, a flat emitter configured for use in an X-ray tube is presented. The X-ray tube includes a first conductive section including a first terminal. Further, the X-ray tube includes a second conductive section including a second terminal. Also, the X-ray tube includes a third conductive section disposed between the first conductive section and the second conductive section, wherein the third conductive section is configured to emit electrons toward a determined focal spot, and wherein the third conductive section includes a plurality of slits subdividing the third conductive section into a winding track coupled to the first conductive section and the second conductive section, wherein at least two of the plurality of slits are interwound spirally to compose the winding track, and wherein the winding track is configured to expand and contract based on heat provided to the third conductive section.

In accordance with a further aspect of the present specification, an X-ray tube is presented. The X-ray tube includes a cathode unit configured to emit electrons toward an anode unit. Further, the cathode unit includes a cathode cup including a first voltage terminal and a second voltage terminal.

Also, the cathode unit includes a flat emitter coupled to the cathode cup. The flat emitter includes a first conductive section including a first terminal coupled to the first voltage terminal. Further, the flat emitter includes a second conductive section including a second terminal coupled to the second voltage terminal. Also, the flat emitter includes a third conductive section disposed between the first conductive section and the second conductive section, wherein the third conductive section is configured to emit the electrons toward a determined focal spot on the anode unit, and wherein the third conductive section includes a plurality of slits subdividing the third conductive section into a winding track coupled to the first conductive section and the second conductive section, wherein at least two of the plurality of slits are interwound spirally to compose the winding track and wherein the winding track is configured to expand and contract based on heat provided to the third conductive section.

In accordance with another aspect of the present specification, a method includes subdividing a conductive section in a flat emitter by a plurality of slits so as to compose a winding track between a first terminal and a second terminal of the flat emitter, wherein at least two of the plurality of slits are interwound spirally to compose the winding track, wherein the winding track is configured to provide one or more winding current paths in the conductive section, and wherein the winding track is configured to expand and contract based on heat provided to the conductive section.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As will be described in detail hereinafter, various embodiments of exemplary systems and methods for controlling plastic deformation of a flat emitter are presented. In particular, the flat emitter presented herein at least partly controls mechanical stress imposed on the flat emitter during cyclic thermal loading, which, in turn, at least partly prevents the plastic deformation of the flat emitter. Also, by employing the exemplary flat emitter, evaporation rate of the flat emitter may be significantly reduced, thereby enhancing the life of the flat emitter.

Figure 1:
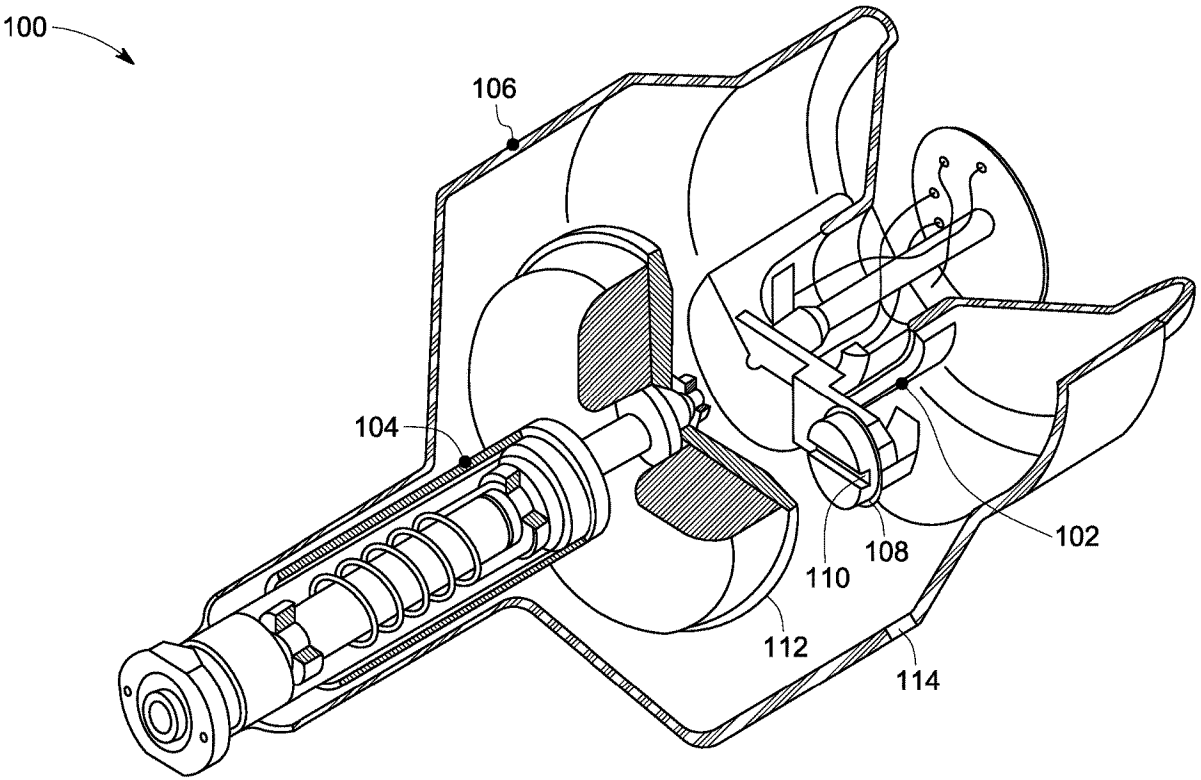
FIG. 1 is a cross sectional view of an X-ray tube, in accordance with aspects of the present specification.

Turning now to the drawings and referring to FIG. 1, a cross sectional view of an X-ray tube 100, in accordance with one embodiment of the present specification, is depicted. The X-ray tube 100 may be used for medical diagnostic examinations. In a presently contemplated configuration, the X-ray tube 100 includes a cathode assembly 102 and an anode assembly 104 that are disposed within an evacuated enclosure 106. It may be noted that the X-ray tube 100 may include other components, and is not limited to the components shown in FIG. 1. In general, the evacuated enclosure 106 may be a vacuum chamber that is positioned within a housing (not shown) of the X-ray tube 100. Further, the cathode assembly 102 includes a cathode cup 108 that is configured to emit electrons towards the anode assembly 104. Particularly, electric current is applied to an electron source, such as a flat emitter 110 in the cathode cup 108, which causes electrons to be produced by thermionic emission. The electric current may be applied by a high voltage connector (not shown) that is electrically coupled between a voltage source (not shown) and the cathode assembly 102.

Furthermore, the anode assembly 104 includes a rotary anode disc 112 and a stator (not shown). The stator is provided with necessary magnetic field to rotate the rotary anode disc 112. Also, the rotary anode disc 112 is positioned in the direction of emitted electrons to receive the electrons from the cathode cup 108. In one example, a copper base with a target surface having materials with high atomic numbers ("Z" numbers), such as rhodium, palladium, and/or tungsten, is employed in the rotary anode disc 112. It may be noted that a stationary anode may also be used instead of the rotary anode disc 112 in the X-ray tube 100.

During operation, the flat emitter 110 in the cathode cup 108 emits a beam of electrons that is accelerated towards the rotary anode disc 112 of the anode assembly 104 by applying a high voltage potential between the cathode assembly 102 and the anode assembly 104. These electrons impinge upon the rotary anode disc 112 at a focal spot and release kinetic energy as electromagnetic radiation of very high frequency, i.e., X-rays. Particularly, the electrons are rapidly decelerated upon striking the rotary anode disc 112, and in the process, the X-rays are generated therefrom. These X-rays emanate in all directions from the rotary anode disc 112. A portion of these X-rays may pass through a window or X-ray port 114 of the evacuated enclosure 106 to exit the X-ray tube 100 and be utilized to interact in or on a material sample, patient, or other object (not shown).

Figure 2:
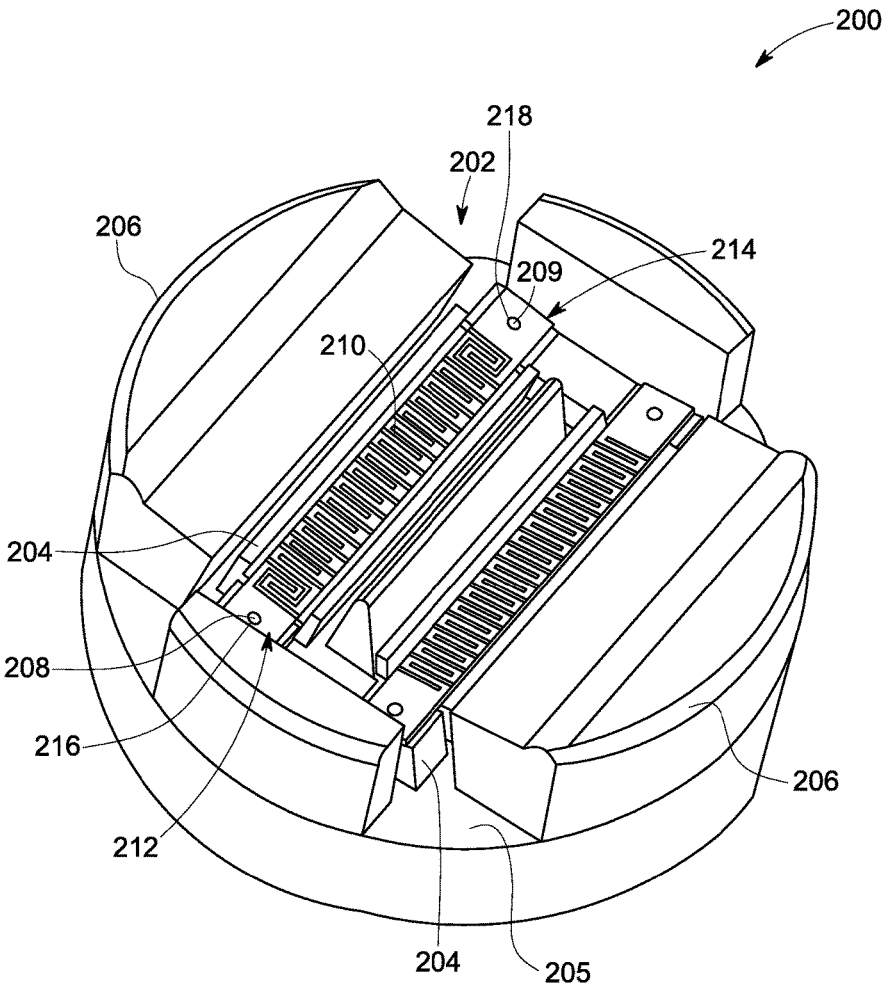
FIG. 2 is a diagrammatical representation of a cathode cup having flat emitters, in accordance with aspects of the present specification.

Referring to FIG. 2, a diagrammatical representation of a cathode cup 200 having flat emitters, in accordance with aspects of the present specification, is depicted. The cathode cup 200 may be similar to the cathode cup 108 of FIG. 1. The cathode cup 200 includes a cavity structure 202 that is employed to focus electron beam towards a focal spot on an anode, such as a rotary anode disc 112 (see FIG. 1) of the X-ray tube 100 (see FIG. 1).

In a presently contemplated configuration, the cathode cup 200 includes one or more support tabs 204 on a bottom surface 205 of the cavity structure 202 and a focus tab 206 on sides of the cavity structure 202. In the example of FIG. 2, the cavity structure 202 includes two support tabs 204 that are separated from each other by a predetermined distance. It may be noted that the cavity structure 202 may include any number of support tabs, and is not limited to two support tabs. Also, for ease of understanding, only one support tab 204 is considered in the below description.

The support tab 204 is configured to hold a flat emitter 210 that is positioned upon the support tab 204. Further, the support tab 204 includes conductive protrusions 208, 209 at two ends of the support tab 204. These conductive protrusions 208, 209 are electrically conductive structures that are configured to act as voltage terminals, such as a first voltage terminal and a second voltage terminal for the flat emitter 210. Consequently, the conductive protrusion 208 at one end may be referred to as a first voltage terminal, while the conductive protrusion 209 at the other end may be referred to as a second voltage terminal.

Further, the flat emitter 210 includes a first terminal 212 and a second terminal 214 at two opposite ends of the flat emitter 210. Also, the first terminal 212 includes a first aperture or hole 216, while the second terminal 214 includes a second aperture or hole 218. Further, when the flat emitter 210 is mounted on the support tab 204, the conductive protrusions 208, 209 of the support tab 204 may overlap or extend out through the first aperture 216 and the second aperture 218 of the flat emitter 210. Particularly, when the flat emitter 210 is mounted on the support tab 204, the first voltage terminal of the support tab 204 may extend out through the first aperture 216 and may electrically couple with the first terminal 212 of the flat emitter 210. In a similar manner, the second voltage terminal of the support tab 204 may extend out through the second aperture 218 and may electrically couple with the second terminal 214 of the flat emitter 210.

Furthermore, the flat emitter 210 is provided with electric current by employing the first voltage terminal and the second voltage terminal of the support tab 204. This electric current is used to heat the flat emitter 210 to a very high temperature, e.g., 2500° C., to provide or emit electrons from the flat emitter 210. In one example, the electrons may be emitted from the flat emitter 210 by thermionic emission. Further, the focus tab 206 of the cathode cup 200 aids in focusing the emitted electrons towards the focal spot on the rotary anode disc 112. Moreover, during operation, the flat emitter 210 may be subjected to a sequence of cooling and heating cycles to provide a desired beam of electrons towards the focal spot. These cooling and heating cycles may be referred to as cyclic thermal loading, which is explained in greater detail with reference to FIG. 4.

Advantageously, the flat emitter 210 is configured to withstand cyclic thermal loading, while maintaining reasonable flexibility. Accordingly, the flat emitter 210 experiences lower mechanical stress and lower or negligible amounts of plastic deformation over a period of time. Consequently, the flat emitter 210 may be able to substantially retain its original shape as well as flatness. As a result, the focal spot quality of the X-ray tube may be retained.

In certain embodiments, the exemplary flat emitter 210 is employed in the cathode cup 200 to lower or substantially avoid plastic deformation and to improve the focal spot quality in the X-ray tube 100. Particularly, the flat emitter 210 is provided with spring structure that is configured to expand and contract under cyclic thermal loading. Advantageously, this spring structure in the flat emitter 210 may aid in substantially reducing mechanical stress on the flat emitter 210, which in turn reduces plastic deformation and improves the life of the flat emitter 210. The aspect of reducing the plastic deformation in the flat emitter 210 is explained in greater detail with reference to FIG. 3.

Figure 3:
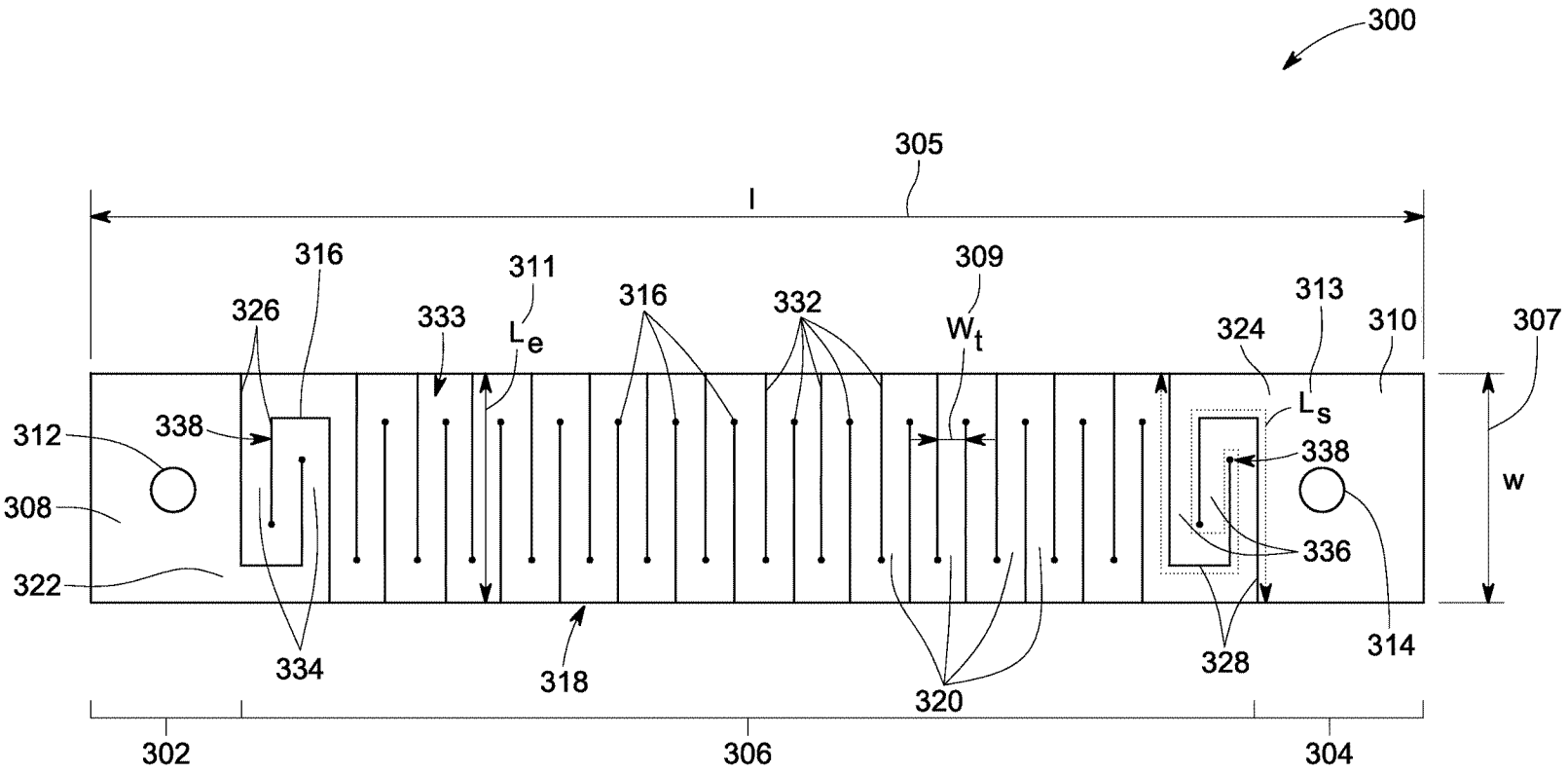
FIG. 3 is a diagrammatical representation of a flat emitter having flexible emission segments, in accordance with aspects of the present specification.

Referring to FIG. 3, a diagrammatical representation of a flat emitter 300, in accordance with aspects of the present specification, is depicted. It may be noted that the flat emitter 300 depicted in FIG. 3 is a pictorial representation, and is not drawn to a scale. The flat emitter 300 is a conductive strip that is divided into three conductive sections, such as a first conductive section 302, a second conductive section 304, and a third conductive section 306. The first conductive section 302 and the second conductive section 304 are positioned at two ends of the flat emitter 300, while the third conductive section 306 is positioned between the first conductive section 302 and the second conductive section 304. Also, the third conductive section 306 is coupled to the first conductive section 302 and the second conductive section 304, as depicted in FIG. 3. Further, the length (1), represented by reference numeral 305, of the flat emitter 300 is in a range from about 12 mm to about 20 mm. Also, the width (w), represented by reference numeral 307, of the flat emitter 300 is in a range from about 1.5 mm to about 5 mm. Additionally, the thickness of the flat emitter 300 is in a range from about 50 μm to about 250 μm, wherein the thickness is represented by a dimension of the flat emitter 300 that is perpendicular to the plane of the paper. It may be noted that the illustrated designs/structures of the flat emitter should not be construed as restrictive, and that other such structures having spring like design are envisioned within the purview of the present application. Additionally, combinations of two or more designs illustrated in various FIGS. 5-7 in this application are also envisioned within the purview of the present application.

Further, the first conductive section 302 includes a first terminal 308, while the second conductive section 304 includes a second terminal 310. The first terminal 308 may include a first aperture 312 that is configured to electrically couple with a first voltage terminal 208 of the cathode cup 200 (see FIG. 2). In a similar manner, the second terminal 310 may include a second aperture 314 that is configured to electrically couple with a second voltage terminal 209 of the cathode cup 200. In one example, the diameter of the first aperture 312 and the second aperture 314 is in a range from 60 μm to 160 μm. In one embodiment, the terminals 308, 310 of the flat emitter 300 may be coupled to the terminals 208, 209 of the cathode cup 200 by welding, brazing, or other similar techniques.

In certain embodiments, the third conductive section 306 includes a plurality of slits or cuts 316 that define a winding track 318 in the third conductive section 306. Particularly, the plurality of slits or cuts 316 are formed in a predefined pattern to obtain a plurality of emission segments 320 that are serially coupled/connected to each other. In one example, the width 307 of each of the plurality of slits 316 is in a range from about 20 μm to about 60 μm. Further, these individual connected emission segments 320 in the third conductive section 306 are collectively referred to as the winding track 318. It may be noted that the winding track 318 is a physically continuous structure with no joints or cuts in between. However, in the present technique, the winding track 318 is shown as the segments serially connected to each other for understanding of the present technique. In one example, the plurality of slits or cuts 316 may be formed by using electrical discharge machining (EDM) or laser machining. Further, the winding track 318 includes a first end 322 coupled to the first conductive section 302 and a second end 324 coupled to the second conductive section 310. Furthermore, the width (Wt), represented by reference numeral 309, of the winding track 318 is in a range from about 0.2 mm to about 0.4 mm.

Moreover, in the exemplary embodiment of FIG. 3, the plurality of slits 316 in the third conductive section 306 includes a first pair of bent slits 326, a second pair of bent slits 328, and a plurality of slits 332 between the first and second pairs of bent slits 326, 328. Further, the plurality of slits 332 may be positioned at one or more angles with respect to the length (1) 305 of the flat emitter 300 along the width (w) 307 of the flat emitter 300 to compose the connected emission segments 320 between the first pair of bent slits 326 and the second pair of bent slits 328 into a sinusoidal shape. Particularly, the slits 332 may aid in composing an up-down structure or serpentine structure of the connected emission segments 320 between the first pair of slits 326 and the second pair of slits 328, as depicted in FIG. 3. It may be noted that these emission segments 320 that are formed by the slits 332 are referred to as vertical emission segments 333. Also, each of these vertical emission segments 333 may have a first determined length (Le) 311. In one example, the first determined length (Le) 311 may be in a range from about 1.5 mm to 2.5 mm.

Further, the first pair of bent slits 326 is interwound spirally at the first end 322 of the third conductive section 306 to compose a pair of emission segments 334 into a spiral shape at the first end 322, as depicted in FIG. 3. Similarly, the second pair of bent slits 328 is interwound spirally at the second end 324 of the third conductive section 306 to compose a pair of emission segments 336 into a spiral shape at the second end 324. In one embodiment, each bent slit of the first pair and the second pair of bent slits 326, 328 includes three arms, such that two arms are parallel to one another and at 90 degrees angle to another arm that is coupled to the two arms. However, it may be noted that the arms may or may not be parallel to one another. Non-limiting examples of the bent slits 326, 328 may include V-shaped slits, U-shaped, trapezoidal slits. It may be noted that length of the arms of the bent slits 326, 328 may or may not be same. Also, where one arm of the bent slits 326, 328 may be perpendicular to at least one other arm. It may be noted that the emission segments 334, 336 in a spiral shape are referred to as spiral emission segments 338. In one example, these spiral emission segments 338 may have a second determined length (Ls) 313 that is about twice the first determined length (Le) 311. Particularly, the spiral emission segments 338 are longer in length compared to the vertical emission segments 333. In one example, the second determined length (Ls) 313 may be in a range from about 2 mm to 5 mm. It may be noted that each of the spiral emission segments 338 may also be referred as a folded ribbon structure.

Figure 4A:
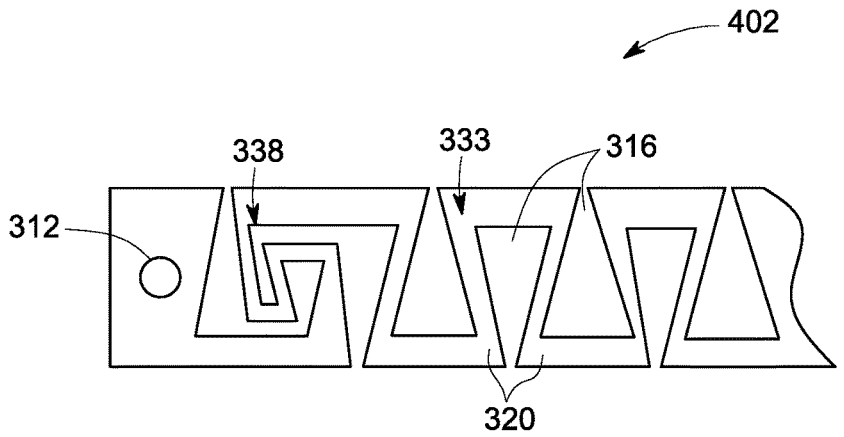
FIGS. 4A-4C are diagrammatical representation of stress experienced by the flat emitter of FIG. 3 subjected to different stages of cyclic thermal loading, in accordance with aspects of the present specification.
Figure 4B:
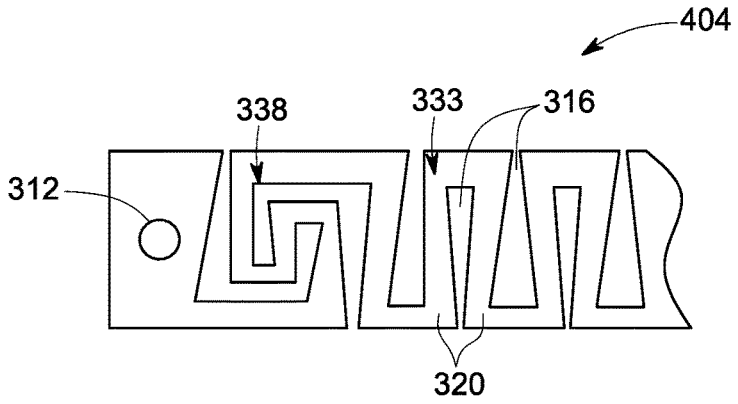
Figure 4C:
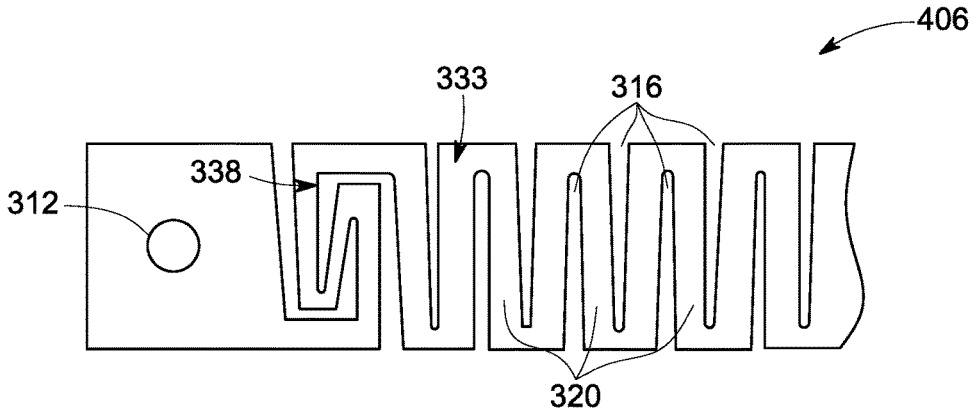

During operation, these spiral emission segments 338 may act like spring structure and may substantially reduce stiffness at the ends 322, 324 of the third conductive section 306. Also, as these spiral emission segments 338 are longer in length compared to the length of the vertical emission segments 333, the spiral emission segments 338 may provide larger deflection compared to the vertical emission segments 333. Particularly, as depicted in FIGS. 4A-4C, the flat emitter 300 along with the cathode cup 200 may be subjected to different cycles or stages of cyclic thermal loading while emitting the electrons. The flat emitter 300 depicted in FIGS. 4A-4C is a pictorial representation, and is not drawn to a scale. For example, as depicted in FIG. 4A, in a first cycle or stage 402, electric current is supplied to the flat emitter 300 to heat the flat emitter 300 to a determined temperature. In this stage 402, the flat emitter 300 is hot, while the cathode cup 200 is cold. Hence, the emission segments 333 in the third conductive section 306 may expand and create compressive stress at the hole or aperture 312, 314 of the flat emitter 300. In one example, the compressive stress may be around 500 MPa. However, the spiral emission segments 338 in the flat emitter 300 may provide more elasticity at the ends of the third conductive section 306, which in turn reduces the compressive stress on the flat emitter 300. As a consequence, deformation of the flat emitter 300 may be substantially reduced.

Further, as depicted in FIG. 4B, in a second cycle or stage 404, the flat emitter 300 is maintained hot and the cathode cup 200 is also heated. As the cathode cup 200 is heated, the compressive stress is released in the flat emitter 300. Particularly, the heat is distributed across the flat emitter 300 and the cathode cup 200, which in turn reduces the stress in the flat emitter 300. In one embodiment, the stress may be reduced by 30% of the compressive stress in the first cycle or stage 402. In one example, the stress in this stage 404 is around 380 MPa. However, the spiral emission segments 338 in the flat emitter 300 may provide more elasticity at the ends of the third conductive section 306, which in turn reduces the compressive stress on the flat emitter 300. As a consequence, deformation of the flat emitter 300 may be substantially reduced. Moreover, in this stage 404, the temperature difference between the flat emitter 300 and the cathode cup 200 is low. Hence, the stress in this stage 404 is less than the stress in the stage 402.

Furthermore, as depicted in FIG. 4C, in a third cycle or stage 406, supply of electric current to the flat emitter 300 is seized. This, in turn cools the flat emitter 300. However, the heat present in the cathode cup 200 may not be reduced instantly. In one example, the heat in the cathode cup 200 may gradually reduce over a relatively longer time than the flat emitter 300. Thus, in the third stage 406, the flat emitter 300 may be colder than the cathode cup 200. Hence, the emission segments 333 in the third conductive section 306 may relax and create tensile stress at the holes or apertures 312, 314 of the flat emitter 300. In one example, the tensile stress on the flat emitter 300 may be around 228 MPa. Here again, the spiral emission segments 338 in the flat emitter 300 may provide more elasticity at the ends of the third conductive section 306, which in turn reduces the tensile stress on the flat emitter 300. As a consequence, undesirable deformation of the flat emitter 300 may be substantially reduced.

Advantageously, the spiral emission elements 338 of the exemplary flat emitter 300 are configured to substantially reduce the mechanical stress otherwise imposed by cyclic thermal loading on the flat emitter 300. Also, the spiral elements 338 of the exemplary flat emitter 300 are configured to prevent or substantially reduce plastic deformation of the flat emitter 300, which in turn facilitates in maintaining the focal spot quality in the X-ray tube. It may be noted that the illustrated designs/structures of the flat emitter should not be construed as restrictive, and that other such structures having spring like design are envisioned within the purview of the present application.

Figure 5:
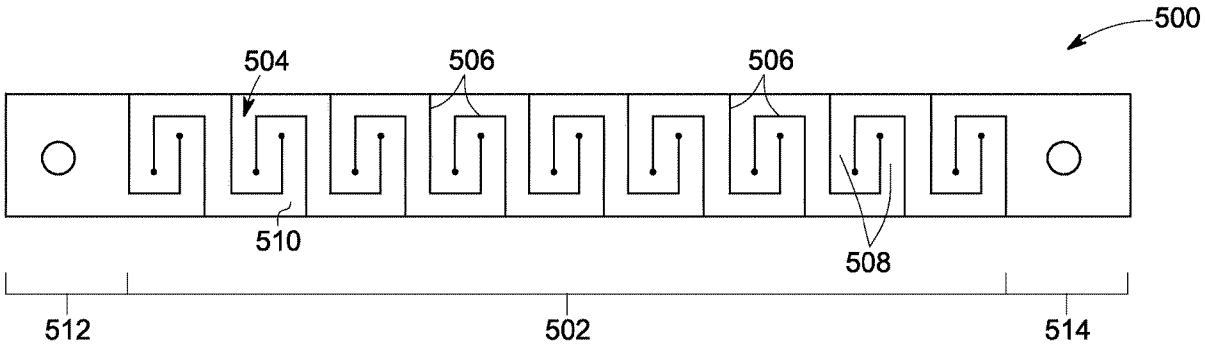
FIGS. 5-7 are diagrammatical representations of flat emitters having different patterns of conductive tracks, in accordance with aspects of the present specification.

Referring to FIG. 5, a diagrammatical representation of a flat emitter 500, in accordance with another embodiment of the present specification, is depicted. The flat emitter 500 is similar to the flat emitter 300 of FIG. 3. In the illustrated embodiment, the flat emitter 500 has a third conductive section 502 that includes only spiral emission segments 504. Particularly, the third conductive section 502 includes a plurality of pairs of slits 506 that are interwound spirally to compose pairs of emission segments 508 into a spiral shape. Also, these pairs of emission segments 508 are serially connected to each other to form a winding track 510 between a first conductive section 512 and a second conductive section 514 of the flat emitter 500.

During operation, the spiral emission segments 504 in the flat emitter 500 may provide winding current paths along the third conductive section 502 of the flat emitter 500. Further, when electric current flows through these meandering current paths, the flat emitter 500 is heated to a very high temperature, e.g., 2500° C. At this high temperature, the flat emitter 500 may expand and may induce mechanical stress, particularly at the ends of the flat emitter 500. However, the exemplary flat emitter 500 includes spiral emission segments 504 that are longer in length and may act like spring structure when the flat emitter 500 is heated to this high temperature. This in turn, reduces mechanical stress on the flat emitter 500 and may prevent plastic deformation of the flat emitter 500.

Figure 6:
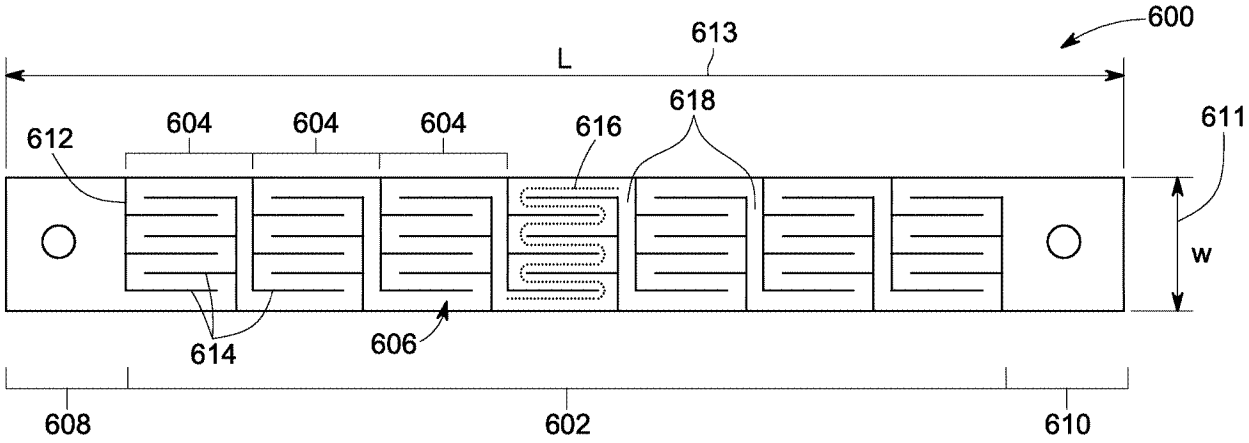

Turning to FIG. 6, a diagrammatical representation of a flat emitter 600, in accordance with yet another embodiment of the present specification, is depicted. The flat emitter 600 is similar to the flat emitter 300 of FIG. 3. In the illustrated embodiment, a third conductive section 602 of the flat emitter 600 includes a plurality of sub-tracks 604 that are serially coupled to each other to compose a winding track 606 between a first conductive section 608 and a second conductive section 610. In one example, each of the sub-tracks 604 may be referred to as a current conducting path that is between two adjacent vertical emission segments 618. Further, each of these sub-tracks 604 has a sinusoidal shape along the width (W) 611 of the flat emitter 600. Particularly, the third conductive section 602 is subdivided by a plurality of vertical slits 612 and horizontal slits 614 in a predefined pattern to compose the third conductive section 602 in a sequence of sub-tracks 602 that are serially connected to each other, as depicted in FIG. 6. The vertical slits 612 and horizontal slits 614 are referred to with reference to the length (L) 613 of the flat emitter 600. By way of example, the vertical slits 612 are positioned perpendicular to the length (L) 613 of the flat emitter 600. Similarly, the horizontal slits 614 are positioned parallel to the length (L) 613 of the flat emitter 600. Also, each of these sub-tracks 604 includes an up-down structure of emission segment 616 arranged in a sinusoidal shape. It may be noted that an emission segment 616 in each sub-track may be referred to as sinusoidal emission segment. The sinusoidal emission segment 616 in each sub-track 604 is positioned in a longitudinal direction that is, along the length (L) 613 of the flat emitter. Also, this sinusoidal emission segment 616 in each sub-track 604 may provide winding current paths in the third conductive section 602.

Further, the sinusoidal emission segment 616 has longer length compared to the spiral emission segment 338 in FIG. 3. Additionally, a S-shaped link between the sinusoidal emission segments 616 has longer length. This in turn helps in providing larger deflection when the flat emitter 600 is subjected to heating and cooling cycles. As a consequence, the flat emitter 600 may have less mechanical stress and minimal or no plastic deformation in the flat emitter 600.

Figure 7:
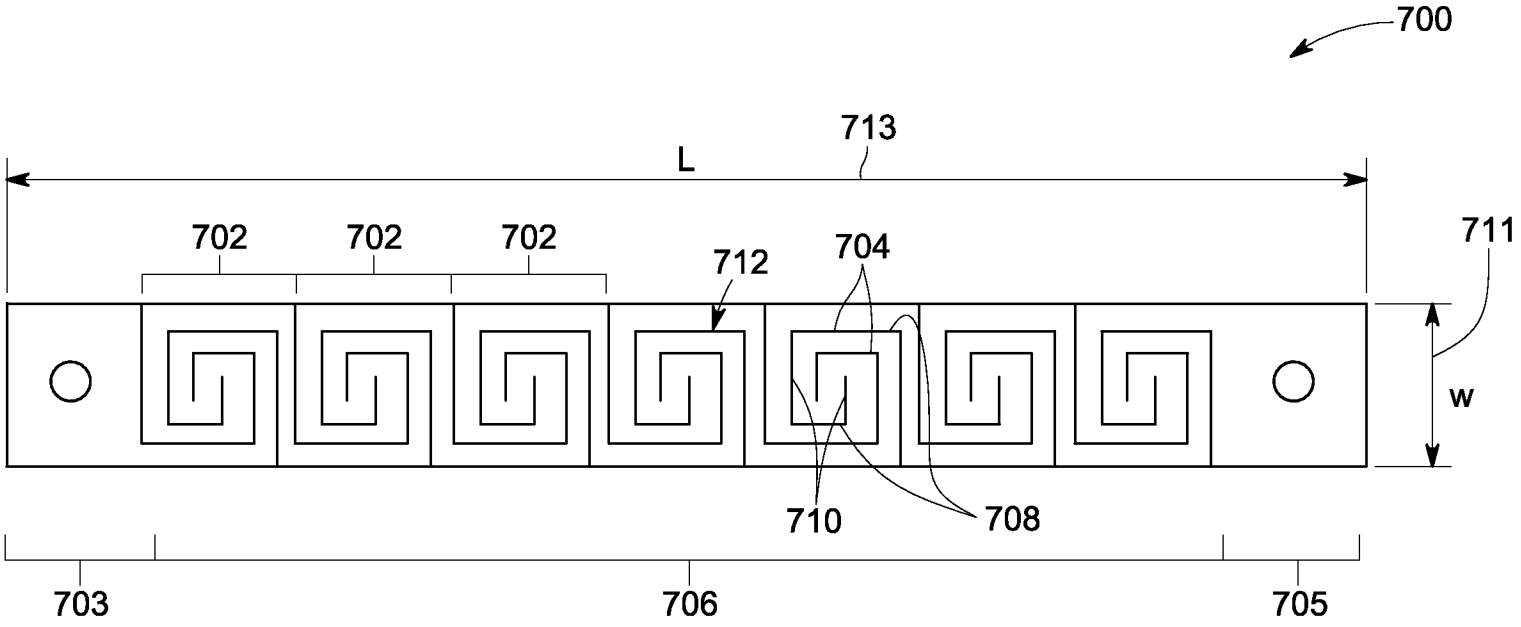

Referring to FIG. 7, a diagrammatical representation of a flat emitter 700, in accordance with yet another embodiment of the present specification, is depicted. The flat emitter 700 is similar to the flat emitter 600 of FIG. 3. In particular, the flat emitter 700 includes a first conductive section 703, a second conductive section 705, and a third conductive section 706. Further, the third conductive section 706 includes one or more sub-tracks 702 that are composed into a spiral shape. Particularly, each of the sub-tracks 702 is composed by a pair of slits 702 that are interwound spirally in the third conductive section 706. Also, each of the pair of slits 704 includes at least two horizontal slits 708 and two vertical slits 710 that are alternately connected to each other to form a single spiral slit, as depicted in FIG. 7. The horizontal slits 708 and vertical slits 710 are referred to with reference to the length (L) 713 of the flat emitter 700. By way of example, the vertical slits 710 are positioned perpendicular to the length (L) 713 of the flat emitter 700. Similarly, the horizontal slits 708 are positioned parallel to the length (L) 713 of the flat emitter 700. It may be noted that an emission segment 712 in each sub-track 702 may be referred to as double spiral emission segment. Moreover, the double spiral emission segment 712 in each sub-track 704 is positioned along the width (W) 711 of the flat emitter 700. Also, this spiral emission segment 712 in each sub-track 702 may provide winding current paths in the third conductive section 706.

Further, the double spiral emission segment 712 may have longer length compared to the spiral emission segments 338 of FIG. 3. This in turn helps in providing larger deflection when the flat emitter 700 is subjected to heating and cooling cycles. As a consequence, the flat emitter 700 may have less mechanical stress and minimal or no plastic deformation.

In one another embodiment, the plurality of slits may include a first number of slits that are arranged vertically and/or horizontally to compose at least a portion of the winding track into a sinusoidal shape. In yet another embodiment, the plurality of slits may include a second number of slits that are arranged spirally to compose at least a portion of the winding track into a spiral shape.

During operation, these emission segments in the winding track may provide elasticity to the flat emitter. Particularly, when the flat emitter is subjected to cyclic thermal loading, the emission segments in the flat emitter may provide larger deflection compared to the conventional flat emitter. As a result of this larger deflection in the flat emitter, mechanical stress on the flat emitter may be substantially reduced. This in turn prevents plastic deformation of the flat emitter. Also, by employing the exemplary flat emitter, evaporation rate of the flat emitter may be significantly reduced. This in turn improves the life of the emitter and reduces maintenance cost of the X-ray cathode and the X-ray tube.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A flat emitter configured for use in an X-ray tube, comprising:

a first conductive section comprising a first terminal;

a second conductive section comprising a second terminal; and a third conductive section disposed between the first conductive section and the second conductive section, wherein the third conductive section is configured to emit electrons toward a determined focal spot, wherein the third conductive section comprises a plurality of slits subdividing the third conductive section into a winding track coupled to the first conductive section and the second conductive section, wherein at least two of the plurality of slits are interwound spirally to compose the winding track, wherein the winding track is configured to expand and contract based on heat provided to the third conductive section, and wherein a determined number of the plurality of slits are arranged vertically in the third conductive section to compose the winding track into a sinusoidal shape.

2. The flat emitter of claim 1, wherein the winding track is configured to provide one or more winding current paths along the third conductive section.

3. The flat emitter of claim 1, wherein a second number of the plurality of slits are arranged spirally in the third conductive section to compose the winding track into a spiral shape.

4. The flat emitter of claim 1, wherein the winding track comprises a plurality of sub-tracks serially coupled to each other.

5. The flat emitter of claim 4, wherein each of the plurality of sub-tracks is composed into at least one of a sinusoidal shape and a spiral shape.

6. The flat emitter of claim 5, wherein each of the plurality of sub-tracks is composed into the spiral shape by spirally interwinding at least two of the plurality of slits.

7. The flat emitter of claim 1, wherein a combined length of the first conductive section, the second conductive section, and the third conductive section is in a range from 12 mm to 20 mm.

8. The flat emitter of claim 1, wherein a width of each of the first conductive section, the second conductive section, and the third conductive section is in a range from 1.5 mm to 5 mm.

9. The flat emitter of claim 1, wherein a thickness of each of the first conductive section, the second conductive section, and the third conductive section is in a range from 50 microns to 250 microns.

10. The flat emitter of claim 1, wherein a width of the winding track is in a range from 0.2 mm to 0.4 mm.

11. The flat emitter of claim 1, wherein a width of each of the plurality of slits is in a range from 40 μm to 60 μm.

12. The flat emitter of claim 1, wherein the first terminal comprises a first aperture configured to be electrically coupled to a first voltage terminal of a cathode cup in the X-ray tube.

13. The flat emitter of claim 12, wherein a diameter of the first aperture is in a range from 60 μm to 160 μm.

14. The flat emitter of claim 12, wherein the second terminal comprises a second aperture configured to be electrically coupled to a second voltage terminal of the cathode cup in the X-ray tube.

15. The flat emitter of claim 14, wherein a diameter of the second aperture is in a range from 60 μm to 160 μm.

16. A flat emitter configured for use in an X-ray tube, comprising:

a first conductive section comprising a first terminal;

a second conductive section comprising a second terminal; and a third conductive section disposed between the first conductive section and the second conductive section, wherein the third conductive section is configured to emit electrons toward a determined focal spot, wherein the third conductive section comprises a plurality of slits subdividing the third conductive section into a winding track coupled to the first conductive section and the second conductive section, wherein at least two of the plurality of slits are interwound spirally to compose the winding track, wherein the winding track is configured to expand and contract based on heat provided to the third conductive section, wherein the winding track comprises a plurality of sub-tracks serially coupled to each other, and wherein each of the plurality of sub-tracks is composed into at least one of a sinusoidal shape and a spiral shape.

17. The flat emitter of claim 16, wherein each of the plurality of sub-tracks is composed into the spiral shape by spirally interwinding at least two of the plurality of slits.

18. An X-ray tube comprising:

an anode unit;

a cathode unit configured to emit electrons toward the anode unit, wherein the cathode unit comprises:

a cathode cup comprising a first voltage terminal and a second voltage terminal;

a flat emitter coupled to the cathode cup and comprising:

a first conductive section comprising a first terminal coupled to the first voltage terminal;

a second conductive section comprising a second terminal coupled to the second voltage terminal; and a third conductive section disposed between the first conductive section and the second conductive section, wherein the third conductive section is configured to emit the electrons toward a determined focal spot on the anode unit, wherein the third conductive section comprises a plurality of slits subdividing the third conductive section into a winding track coupled to the first conductive section and the second conductive section, wherein at least two of the plurality of slits are interwound spirally to compose the winding track, wherein the winding track is configured to expand and contract based on heat provided to the third conductive section, and wherein a determined number of the plurality of slits are arranged vertically in the third conductive section to compose the winding track into a sinusoidal shape.

19. The X-ray tube of claim 18, wherein the winding track is configured to provide one or more winding current paths in the third conductive section.

20. A method comprising:

subdividing a conductive section in a flat emitter by a plurality of slits so as to compose a winding track between a first terminal and a second terminal of the flat emitter, wherein at least two of the plurality of slits are interwound spirally to compose the winding track, wherein the winding track is configured to provide one or more winding current paths in the conductive section, wherein the winding track is configured to expand and contract based on heat provided to the conductive section, and wherein subdividing the conductive section comprises arranging a first number of the plurality of slits vertically to compose at least a portion of the winding track into a sinusoidal shape.

21. The method of claim 20, wherein subdividing the conductive section comprises arranging a second number of the plurality of slits spirally to compose the winding track into a spiral shape.

* * * * *